United States Patent [19]

Treadway

[11] Patent Number: 4,545,440

[45] Date of Patent: Oct. 8, 1985

[54] ATTACHMENT FOR PNEUMATIC HAMMERS FOR PUNCHING HOLES OF VARYING SIZE

[76] Inventor: John E. Treadway, 10510 Crecelius Dr., St. Louis, Mo. 63123

[21] Appl. No.: 482,944

[22] Filed: Apr. 7, 1983

[51] Int. Cl.[4] ..... B21D 31/02

[52] U.S. Cl. ..... 173/132; 173/133; 83/660; 72/325

[58] Field of Search ..... 173/132, 133; 72/324, 72/325, 412, 413, 414, 415, 416; 83/660; 279/112

[56] References Cited

U.S. PATENT DOCUMENTS

| | | | |
|---|---|---|---|
| 618,100 | 1/1899 | Johnson . | |
| 691,334 | 1/1902 | Birkenstock . | |
| 1,329,774 | 2/1920 | Keller . | |
| 1,331,353 | 2/1920 | Nurnberger . | |
| 1,712,436 | 5/1929 | Jimerson . | |
| 2,220,195 | 11/1940 | Amundsen | 173/133 X |
| 2,231,496 | 2/1941 | Fuehrer . | |
| 2,237,875 | 4/1941 | Brown | 279/112 X |
| 2,241,184 | 5/1941 | Clark . | |
| 2,392,560 | 1/1946 | Vitoux | 173/133 X |
| 2,413,542 | 12/1946 | Butts | 91/234 X |
| 2,604,072 | 7/1952 | Beckett et al. . | |
| 3,559,445 | 2/1971 | Hougen | 83/660 X |
| 4,239,143 | 12/1980 | Johnson | 173/133 X |

*Primary Examiner*—James M. Meister
*Assistant Examiner*—Willmon Fridie, Jr.
*Attorney, Agent, or Firm*—Glenn K. Robbins

[57] ABSTRACT

A device for punching holes of varying size in sheet metal by a pneumatic hammer. A tapered punch is employed with an adjustment at the muzzle end of the hammer which selectively limits the travel and penetration of the punch thereby determining the size of the hole. A special attachment for the tapered punch and a punch holder for the punch is provided for attachment to the muzzle end of the pneumatic hammer. The attachment is in the form of a housing which receives the punch and punch holder and can be screwed on the muzzle end of a pneumatic hammer and present the punch holder to the internal hammer like drive of a conventional pneumatic hammer.

8 Claims, 6 Drawing Figures

ATTACHMENT FOR PNEUMATIC HAMMERS FOR PUNCHING HOLES OF VARYING SIZE

BACKGROUND OF THE INVENTION

In the past various types of pneumatic hammers have been used in industry which provide a reciprocatory driving action for tools such as hammers, chisels, cutters, coarse punches and the like. Such tools are conventionally operated by pressing the tool held at the muzzle end of the hammer against a work piece. This action presents a rear driving or anvil end of the tool to engagement by a reciprocal driving member or internal hammer of the hammer to move the tool forward for the desired hammering, chiseling or coarse punching operation.

The punching of holes of varying size and preciseness of size with which this invention is concerned has presented a problem. The reciprocating coarse punches of the past have been of no use in punching consistent size holes for example in light sheet metal. Hand held punches or awls struck by a hammer are customarily employed which are tedious and time consuming, accident prone and require considerable energy and caution.

SUMMARY OF THE INVENTION

By means of this invention there has been provided an adjustment mechanism for pneumatic hammers for use with sharp pointed awl-like tapered punches to vary the depth of penetration and in so doing vary the size of the punched hole to a desired and precise and consistent diameter. The adjustment means is simply manipulated at the muzzle end of the hammer to vary effectively the distance of the path of penetration travel of the punch and in so doing make the hole larger as the penetration travel is increased and reduce the size of the hole as the penetration travel is decreased. In its simplest form the adjustment mechanism comprises at the muzzle end of the hammer an adjustable punch guide or adjustment screw which has a tubular barrel receiving the tapered punch which is adapted to be moved in a reciprocatory fashion when the exposed front end of the tapered punch is pressed against the work piece in which a hole is to be punched. By screwing the adjustable punch guide into or out of the muzzle end of the pneumatic hammer the length of travel of the tapered front end of the punch in front of the punch guide may be varied to determine the size of the punched hole since the adjustable punch guide acts as a stop when it reaches the sheet metal work piece being punched.

Further, by means of this invention the tapered punch may be used as a separate replaceable simple and inexpensive component since it may be used with a punch holder which is positioned in the hammer between the reciprocal hammer and the punch. The holder has a rear anvil portion which is exposed to the force of the hammer when the protruding portion of the punch is pressed against the work piece to force the punch rearwardly. The forward end of the holder has a cup-shaped recess which receives the rear end of the punch to facilitate easy interchange for replacement of broken punches or punches of different configurations as desired.

In a particular embodiment of the invention the adjustable punch feature is incorporated into an attachment which may be utilized in existing conventional pneumatic hammers. The attachment incorporates an internally threaded housing which may be simply fitted over the conventional externally threaded muzzle end of stock pneumatic hammers which receive the thick wire-like stock tool holders.

The attachment housing has an internal chamber receiving the tool holder and the rear end of the tapered punch and an internal barrel like opening extending to the muzzle of the housing and which receives the tapered punch. The housing is simply interfitted on the muzzle end of the stock pneumatic hammer and presents the rear or anvil end of the tool holder to the drive mechanism of the hammer for ready operation.

The adjustment guide or adjustment screw utilized to vary the penetration travel of the tapered end of the punch to determine the hole size is formed in the front or muzzle end of the attachment housing. It is simply constructed of an externally threaded tubular member which slidably receives the punch in its tubular barrel. By a threaded interfit within the muzzle end of the attachment housing it may be screwed into our out of the housing for the aforementioned adjustment. The front or muzzle end of the guide in use acts as a rest or stop when pressed against the work piece being punched.

The attachment housing is simply interfitted upon the muzzle end of the pneumatic hammer with which it is employed. A specially designed clamp is formed as part of the housing with a tightening screw that tightens both the housing to the hammer and the punch adjustment guide in the housing in a single operation.

The punch adjustment mechanism and specially designed attachment are simple in construction and operation and may be utilized without any complicating mechanisms. The rugged and efficient features of construction provide wide adapatability for use as will be readily appreciated.

The above features are objects of this invention. Further objects will appear in the detailed description which follows and will be otherwise apparent to those skilled in the art.

For the purpose of illustration of this invention a preferred embodiment thereof is shown in the accompanying drawing. It is to be understood that this is for the purpose of example only and that the invention is not limited thereto.

IN THE DRAWING

DESCRIPTION OF THE INVENTION

Figure 1:
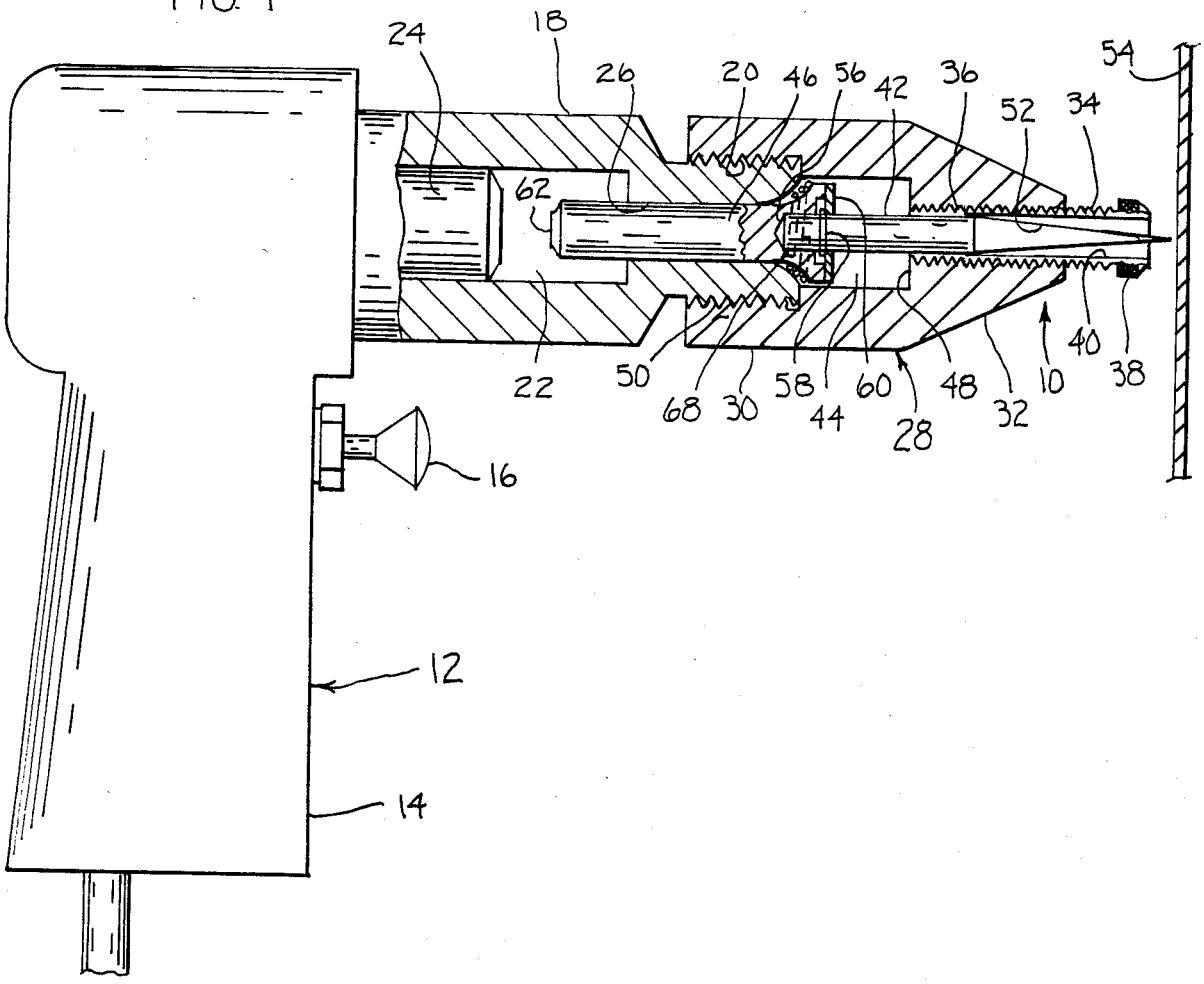
FIG. 1 is a view in side elevation of a pneumatic hammer showing a portion of the front of the barrel and the punch adjustment attachment in axial cross-section.

The punch hole adjustment of this invention is generally indicated by the reference numeral 10 and is shown in the form of an attachment to a conventional pneumatic hammer 12 which, per se, forms no part of this invention.

The pneumatic hammer 12 is comprised of a hand grip 14, a trigger 16, a barrel 18 and a threaded muzzle end 20 which conventionally receives a thick helical spring-like tool retainer (not shown) which has been removed and replaced by the adjustment attachment 10.

The barrel is provided with a hammer chamber 22 which receives a reciprocatory drive hammer 24 adapted to drive an exposed anvil end of a tool slidably received in a bore 26 extending through the muzzle end.

The aforementioned pneumatic hammer construction is portrayed as a typical exemplification of a conventional pneumatic hammer structure upon which the adjustment attachment can be readily employed without modification.

The adjustment attachment is comprised of a housing 28 having a rear cylindrical portion 30 and a forward tapered or conical muzzle end 32 which receives an adjustable punch guide or adjustment screw 34. An elongated bore hole 36 is internally threaded to receive in axially adjustable relation the adjustable punch guide which is in the form of an externally threaded tubular member to be received in the threaded bore hole.

Figure 5:
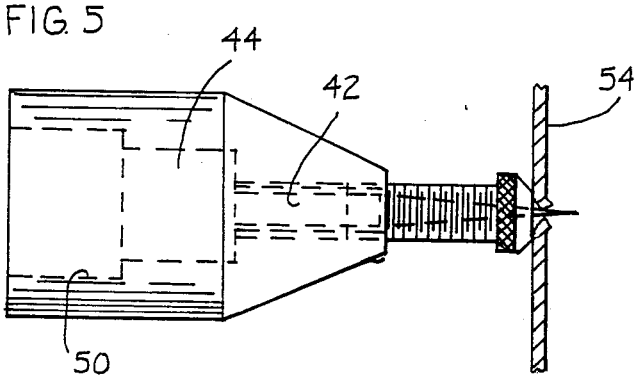
FIG. 5 is a view in elevation of the attachment showing the adjustable punch holder in a small hole size position.
Figure 6:
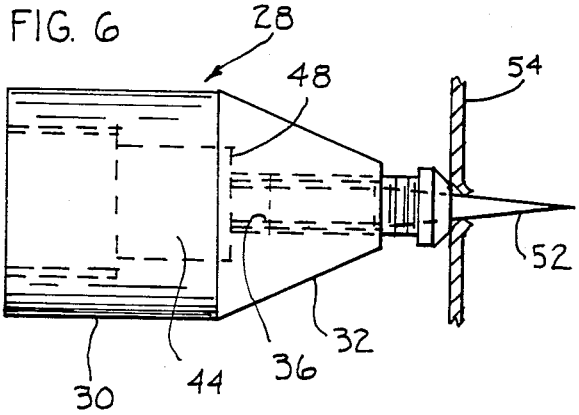
FIG. 6 is a view similar to FIG. 5 but showing the punch holder adjusted to a larger hole size position.

The punch guide has an enlarged knurled front collar 38 for easy grasping by the thumb and forefinger of the operator to turn the guide to the desired position of adjustment as typified in FIGS. 5 and 6. The interior bore opening 40 of the punch guide closely receives a sharp pointed awl-like punch 42 which is driven forward by the drive mechanism of the gun as will be described.

The rear cylindrical portion 30 of the housing is provided with an enlarged chamber 44 which receives a punch holder 46 and the rear end of the punch as best shown in FIG. 1. The chamber has a shoulder 48 at the forward end of the chamber which separates the chamber from the bore hole 36. The rear portion of the chamber is internally threaded at 50 in order that the housing 28 may be screwed onto the threaded muzzle end and unscrewed for punch replacement and the like.

The punch 42 has a gradually tapered sharp pointed front end 52 which depending on the extent of penetration of a sheet metal work piece 54 determines the size of the hole being punched. The punch guide adjustment screw is adjusted into or out of the muzzle 32 of the housing to increase and reduce the extent of such penetration and enlarge or reduce the size of the hole correspondingly.

The punch has a tapered rear end 56 which is received in a front end of the punch holder as will appear. A retaining ring 58 is fitted to the punch 42 to serve as a stop for a washer 60 which acts as a stop against the shoulder 48 of the chamber as the punch is driven downwardly and to limit the forward movement of the punch.

Figure 2:
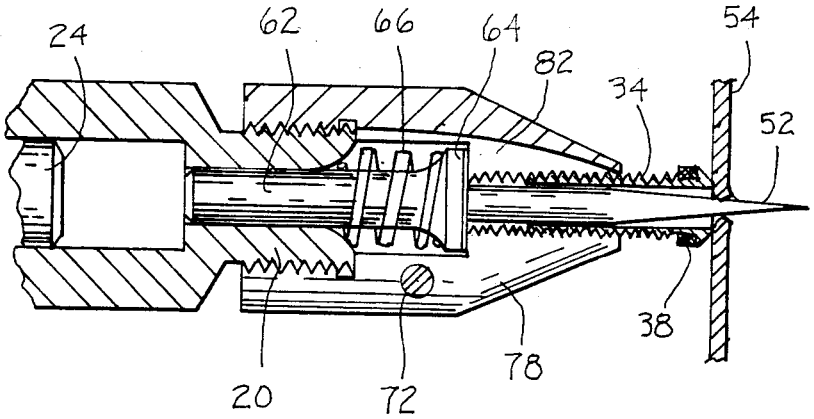
FIG. 2 is a fragmentary sectional view of the barrel and attachment similar to FIG. 1 after firing.

The punch holder 46 as best shown in FIGS. 1 and 2 has a rear anvil portion 62 which is adapted to be exposed to the driving force of the internal hammer 24 of the pneumatic hammer when the punch is pressed against a work piece. An enlarged head 64 is provided at the front end of the punch holder and serves as a seat for a spring 66 which seats at an opposite end against the hammer muzzle. The spring urges the anvil away from engagement by the internal hammer until the punch is moved rearwardly by engagement with a work surface and thereby provides a safety feature against premature firing. The punch holder is further provided with a tapered axial opening 68 which receives the rear mating congruent tapered rear end of the punch. The cup-shaped recess provided in the holder serves to easily seat the punch in the work holder for the force created in the driving operation and provides a slight tolerance in alignment to accommodate the different bore hole movement of the punch holder and punch. The retaining ring is positioned sufficiently forward of the rear end of the punch so as not to be contacted by the holder to avoid damage to the retaining ring.

Figure 3:
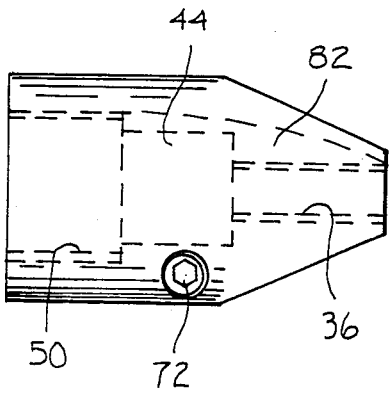
FIG. 3 is a view in side elevation of the attachment.
Figure 4:
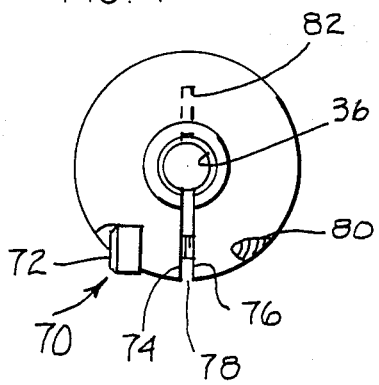
FIG. 4 is a view in front elevation of the attachment taken from the right side of FIG. 3.

In order to lock the attachment housing to the muzzle of the hammer and secure the punch guide or adjustment screw to the housing a clamp 70 is provided as best shown in FIGS. 2, 3 and 4. The clamp is comprised of a locking screw 72 which is adapted to draw sides 74 and 76 on either side of an axial slot 78 of the housing together when the screw is tightened into threaded opening 80. The slot 78 extends halfway through the housing radially from the central chamber opening and bore opening to the exterior of the housing. A second slot 82 on the other side of the housing extends only partially to the exterior of the housing and provides additional relief for the clamping of the adjustment punch guide.

USE

The pneumatic hammer with the punch adjustment is very simply employed in the punching of holes in sheet metal of various types and for a variety of different purposes and applications. Exemplary of such use and without limitation is the punching of holes in the dented sheet metal of automobiles and trucks, insertion of a screw tool or dent puller and pulling out the surrounding dented surface. The punched hole is stiffened and provides extra screw contact as contrasted to a drilled hole where the edges are lifted and must be ground off thereby enlarging the hole and thinning the surrounding metal.

The attachment housing 28 is easily and rapidly loaded with the punch and punch holder by simple insertion through the open rear end and fitting the return safety spring 66 around the punch holder. The assembled housing is then threaded upon the threaded muzzle end of the pneumatic hammer. The threaded punch guide or adjustment screw 34 is then screwed into or out of the tapered muzzle end 32 of the attachment housing to present the tapered end of the punch to the desired hole size punch position. The locking screw 72 is then tightened to clamp the housing to the muzzle end of the hammer and the punch guide in the housing. The pneumatic hammer is then ready for use. Disassembly and replacement of a broken or different type of punch is effected in a reverse manner to that as described above.

The hammer in use is employed in a similar fashion to conventional pneumatic hammers in which the operation is effected by pressing the exposed tool end against the work surface to expose the rear anvil end of the tool assembly to engagement by the hammer. When this is effected with the pneumatic hammer and attachment of this invention the actuation of the trigger 16 causes a cyclic operation of the hammer 24 to drive the tool forwardly while the aforementioned engagement of the tool against the work piece effects the return of the anvil portion of the tool against the biasing force of the return safety spring to engagement with the internal hammer.

As best shown in FIGS. 1 and 2 the reciprocal travel of the punch holder and punch is between the rearward limit of the punch holder and punch shown in FIG. 1 to the complete forward and rest position shown in FIG. 2. By the adjustment of the punch guide or adjustment screw 34 the length of effective travel of the tapered punch end 52 in advance of the knurled head 38 may be selected. The head 38 of the punch guide acts as a stop when reaching against the sheet metal and the length or distance of the reciprocal travel of the tapered end of the punch in advance of the head 38 determines the size of the hole.

The adjustment of the punch guide is shown for two positions of adjustment in FIGS. 5 and 6, respectively. The punch guide or adjustment screw is simply screwed into or out of the muzzle end of the attachment housing after first loosening the locking screw 72 and then relocking after the adjustment. In the punch guide extended position shown in FIG. 5 the punch end travel in advance of the punch guide is reduced and only a small hole is punched. In the punch guide retracted position shown in FIG. 6 the punch end travel in advance of the punch guide is increased and a larger hole will be punched. The hole size can accordlngly be varied to a wide and precise degree by appropriate adjustment.

Various changes and modifications may be made in this invention as will be readily apparent to those skilled in the art. Thus, the tapered punch and hole size adjustment features may be incorporated into the hammer structure itself rather than as an attachment. Such changes and modifications are within the scope and teaching of this invention as defined by the claims appended hereto.

What is claimed is:

1. An attachment for pneumatic hammers having reciprocatory internal hammer like drive means for driving a tool such as a hammer, chisel or the like, said attachment comprising a housing having means for supporting a tapered punch and adjustment means for limiting the effective length of travel of the punch exteriorly of the housing to vary the hole size in a work surface in which a hole is to be punched, said housing having an internally threaded rear end removably receivable upon an externally threaded muzzle end of said hammer, said tapered punch having a fixed axial travel within said housing, the housing having an axial opening defined by a forward barrel opening closely receiving said punch and an enlarged chamber opening having a forward boundary shoulder serving as a stop for said punch, said chamber opening having an axial length limiting the fixed reciprocal travel of the punch and said adjustment means having an axially adjustable stop means engageable with the work surface to be punched to limit selectively the travel of the punch in front of said stop means, said adjustment means being a tubular member slidably receiving the tapered punch and the tubular member being supported within said forward barrel opening on a muzzle portion of the housing in engageable relation with said work surface and axially adjustable with respect to said housing and a punch holder for said punch, said punch holder being slidably receivable within said housing and having a rear anvil end portion engageable by the drive means of said hammer and a forward end portion within said enlarged chamber receiving a rear end of said punch.

2. The attachment of claim 1 in which the tubular member is exteriorly threaded and said forward barrel opening being interiourly threaded to support the tubular member therein.

3. The attachment of claim 1 in which said holder has a cup-shaped recess receiving the rear end of said punch and said forward end portion acts as a stop against said muzzle end of said hammer when the holder is moved rearwardly to expose the rear anvil end to engagement with said drive means.

4. The attachment of claim 2 in which said housing has clamping means for clamping the housing to the muzzle end of the hammer and for clamping the tubular adjustment member to the muzzle portion of the housing.

5. The attachment of claim 4 in which the clamping means comprise a radial slit in the housing extending longitudinally from the internally threaded rear end of the housing to said muzzle portion of the housing defining spread apart sides of the housing which are adapted to be clamped together by screw adjustment means connecting said sides to jointly clamp the housing to the muzzle end of the hammer and the tubular adjustment member to the muzzle end of the housing.

6. The attachment of claim 1 in which said muzzle end of said enlarged hammer is receivable within said chamber and said muzzle end defines a rear boundary of said chamber.

7. In a pneumatic hammer having a barrel and reciprocatory drive means for driving a tool, means for supporting a tapered punch in an end of the barrel in drivable relation exteriorly of the end of the barrel responsive to said drive means and adjustment means for limiting the effective length of travel of the punch exteriorly of the housing to vary the hole size in a work surface in which a hole is to be punched, said tapered punch having a fixed reciprocatory axial travel within said housing, the housing having an axial opening defined by a forward barrel opening closely receiving said punch and an enlarged chamber opening having a forward boundary shoulder serving as a stop for said punch, said chamber opening having an axial length limiting the fixed reciprocal travel of the punch and said adjustment means having an axially adjustable stop means engageable with the work surface to be punched to limit selectively the reciprocatory travel of the punch in front of said stop means, said adjustment means being a tubular member slidably receiving the tapered punch and the tubular member being supported within said forward barrel opening on a muzzle portion of the housing in engageable relation with said work surface and axially adjustable with respect to said housing and a punch holder for said punch, said holder being slidably receivable within a muzzle end of the hammer and having a rear anvil end portion engageable by the drive means of the hammer and a forward end portion within said enlarged chamber receiving a rear end portion of the punch.

8. The pneumatic hammer of claim 7 in which said enlarged forward end portion acts as a stop when the holder is moved to rearward and forward limiting positions, said forward end portion being provided with a cup-shaped recess receiving a rear end of said punch in driving relation.

* * * * *